US005718333A

United States Patent [19]

Armour

[11] Patent Number: 5,718,333

[45] Date of Patent: Feb. 17, 1998

[54] GOLF BAG WITH PROTECTIVE HOOD

[75] Inventor: Billy Joe Armour, Springfield, Tenn.

[73] Assignee: Wilson Sporting Goods Co., Chicago, Ill.

[21] Appl. No.: 749,072

[22] Filed: Nov. 14, 1996

Related U.S. Application Data

[63] Continuation of Ser. No. 378,622, Jan. 26, 1995, abandoned.

[51] Int. Cl.[6] ..... A63B 55/00; A63B 57/00

[52] U.S. Cl. ..... 206/315.4; 206/315.3; 206/315.5; 150/159

[58] Field of Search ..... 150/159, 160; 206/315.3, 315.4, 315.5

[56] References Cited

U.S. PATENT DOCUMENTS

| | | | |
|---|---|---|---|
| 1,570,500 | 1/1926 | Kennedy | 206/315.6 |
| 2,094,186 | 9/1937 | Patrick | 206/315.4 |
| 2,114,870 | 4/1938 | Calkins | 206/315.6 |
| 2,165,665 | 7/1939 | Thompson | 206/315.4 |
| 2,587,029 | 2/1952 | Burton, Jr. et al. | 150/1.5 |
| 2,698,040 | 12/1954 | Wilkens | 206/315.5 |
| 2,704,563 | 3/1955 | Henrich | 150/159 |
| 2,861,613 | 11/1958 | Kish, Jr. | 150/1.5 |
| 2,861,614 | 11/1958 | Kish, Jr. | 206/315.5 |
| 2,985,212 | 5/1961 | Dozier | 206/315.4 X |
| 3,259,160 | 7/1966 | Penna | 206/315.5 |
| 3,985,171 | 10/1976 | Summers et al. | 150/52 |
| 4,181,167 | 1/1980 | Ret | 206/315.6 |
| 4,249,586 | 2/1981 | Setani | 206/315.5 |
| 4,263,950 | 4/1981 | Brown | 206/315.6 |
| 4,350,194 | 9/1982 | Brown | 206/315.5 |
| 4,699,164 | 10/1987 | Pilney et al | 206/315.4 X |
| 4,779,725 | 10/1988 | Gerber | 206/315.3 |
| 5,024,259 | 6/1991 | Treadway | 150/159 |
| 5,029,703 | 7/1991 | Dulyea, Sr. | 206/315.3 |
| 5,038,984 | 8/1991 | Izzo | 224/209 |
| 5,042,703 | 8/1991 | Izzo | 224/209 |
| 5,042,704 | 8/1991 | Izzo | 224/209 |
| 5,094,283 | 3/1992 | Lawrence | 150/160 |
| 5,168,992 | 12/1992 | Bowdy | 206/315.6 |
| 5,176,253 | 1/1993 | Perrin et al. | 206/315.5 |
| 5,215,194 | 6/1993 | Blanford et al. | 206/315.3 |
| 5,222,569 | 6/1993 | Jordan | 206/315.6 |
| 5,222,598 | 6/1993 | Yamazoe | 206/315.5 |
| 5,267,660 | 12/1993 | Kwon | 211/70.2 |
| 5,280,798 | 1/1994 | Helm | 150/159 X |
| 5,439,153 | 8/1995 | Murdoch et al. | 150/159 X |
| 5,443,156 | 8/1995 | Shioda | 150/159 X |
| 5,507,332 | 4/1996 | McKinnon | 150/159 |

FOREIGN PATENT DOCUMENTS

| | | | |
|---|---|---|---|
| 376766 | 7/1932 | United Kingdom | 206/315.3 |
| 414178 | 8/1934 | United Kingdom | 206/315.3 |

*Primary Examiner*—Sue A. Weaver
*Attorney, Agent, or Firm*—Tilton, Fallon, Lungmus & Chestnut

[57] ABSTRACT

A golf bag includes a generally tubular bag portion having an elongate body, a bottom and an open top. The bag portion also has a pocket with an access opening. A hood member secured to the bag portion covers the exposed portion of one or more golf clubs disposed in the tubular body. The hood member is extendable to an operable position for covering the top of the bag portion and the club or clubs while being secured to the bag portion and foldable into the pocket for storage while remaining secured to the bag portion.

4 Claims, 1 Drawing Sheet

GOLF BAG WITH PROTECTIVE HOOD

This application is a continuation of application Ser. No. 08/378,622, filed Jan. 26, 1995, now abandoned.

BACKGROUND OF THE INVENTION

1. Field of the Invention

This invention relates to a golf bag with a protective hood, and more particularly to a golf bag with a protective hood that is extensible to an operable position and foldable into a pocket of the bag while remaining secured to the bag.

2. Description of the Prior Art

A golf bag typically includes an elongate, tubular body, closed at a bottom end by a base and open at a top end. The head portions of golf clubs placed in the bag lie outwardly of the open top. Those portions are exposed to rain and other natural elements that may damage them.

The prior art includes various covers for protecting golf clubs and the top portion of the golf bag. U.S. Pat. No. 5,280,798 describes a protective cover for golf clubs and the bag that contains them. The cover includes a club head protector for covering the head of a golf club, a pocket located on the protector, and a sack-like waterproof hood attached to the inside of the pocket. U.S. Pat. No. 4,699,164 describes a rain protector comprising an umbrella-like cover and an elastic sock that receives the head of one of the clubs. U.S. Pat. No. 2,704,563 describes a bag-like cover with tie-strings that secure the cover to the handle of the bag. The covers described above are separate members that one may easily lose.

Unlike the prior art golf bag and cover arrangements, the golf bag of the present invention includes a cover and a storage pocket that form a part of the golf bag. It avoids the disadvantages of the prior art bag and cover arrangements and provides effective protection for golf clubs disposed in the bag and for the top portion of the bag.

SUMMARY OF THE INVENTION

In accordance with one embodiment of this invention, a golf bag includes a generally tubular bag portion having an elongate body, a bottom and an open top. The bag portion also has a pocket with an access opening. A hood member secured to the bag portion covers the exposed portion of one or more golf clubs disposed in the tubular body. The hood member is extendable to a position for covering the club or clubs and the top portion of the golf bag and foldable into the pocket for storage while remaining secured to the bag portion.

BRIEF DESCRIPTION OF THE DRAWINGS

For a more complete understanding of this invention one should now refer to the embodiment illustrated in greater detail in the accompanying drawings and described below by way of an example of the invention. In the drawings.

While the following disclosure describes the invention in connection with one embodiment, one should understand that the invention is not limited to this embodiment. Furthermore, one should understand that the drawings are not to scale and that graphic symbols, diagrammatic representations, and fragmentary views, in part, may illustrate the embodiment. In certain instances, the disclosure may not include details which are not necessary for an understanding of the present invention, such as conventional details of fabrication and assembly.

DETAILED DESCRIPTION OF THE DRAWINGS AND AN EMBODIMENT

Figure 1:
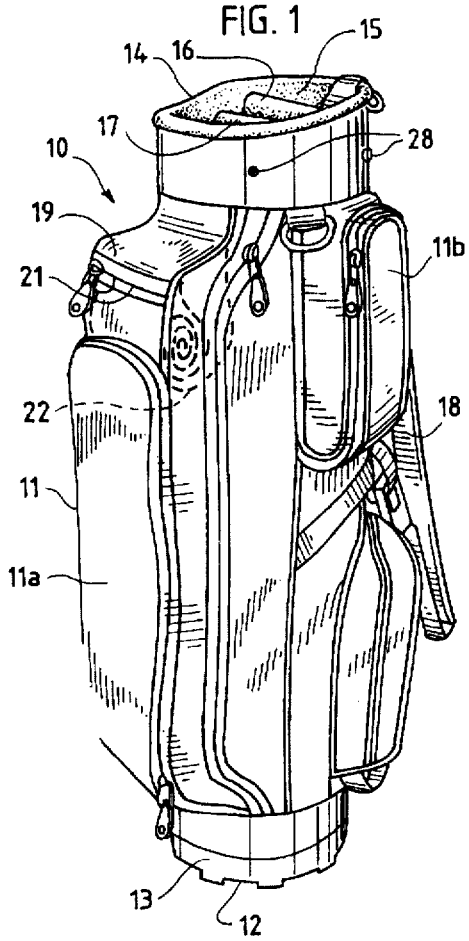
FIG. 1 is a perspective view of the golf bag of the present invention, showing a pocket for a protective hood and the protective hood (shown in hidden lines) disposed in the pocket.

Turning now to the drawings, FIG. 1 shows the golf bag of the present invention generally at 10. The bag 10 includes an elongate, tubular body 11 closed at a bottom end 12 by a base member 13 and open at a top end 14. The body 11 may be fabricated from any suitable material, including any suitable, natural or synthetic, fabric material supported by bracing members such as spaced vertical rods and horizontal rings made of metal or any other material of sufficient strength and rigidity. The base member 13 may also be any suitable material (e.g., plastic).

The body 11 includes a plurality of pockets **11*a* and 11*b* for storing items such as balls, tees, and garments. It defines a central opening 15 divided into compartments by a pair of dividers 16 and 17. These compartments receive a number of golf clubs. A player typically places the clubs into the bag by inserting the handle portion of the club into the body 11. The player may then load the bag onto his or her shoulder using a strap 18** and carry it to a desired location.

Figure 2:
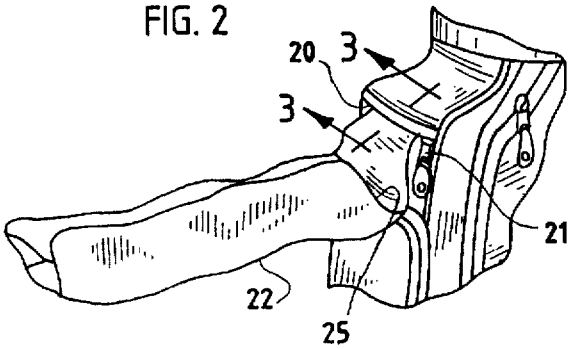
FIG. 2 is a partial perspective view of the golf bag of FIG. 1, showing the protective hood extending outwardly of the storage pocket.
Figure 4:
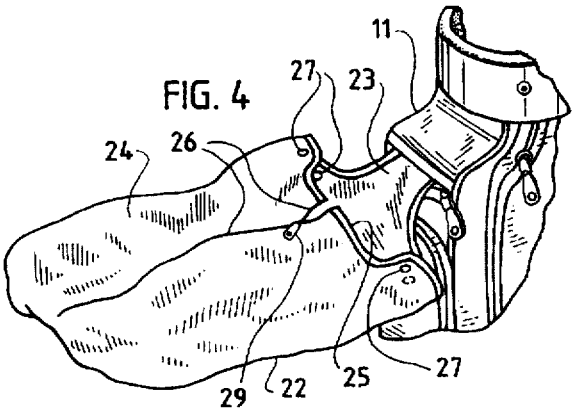
FIG. 4 is the partial perspective view of FIG. 2, showing the protective hood in an unfolded configuration.
Figure 5:
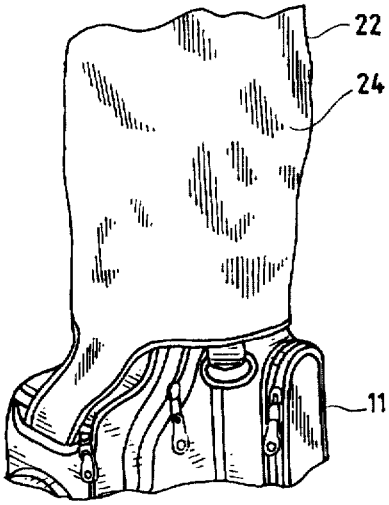
FIG. 5 is a partial perspective view of the top of the golf bag, showing the protective hood disposed over the top opening of the bag.
Figure 6:
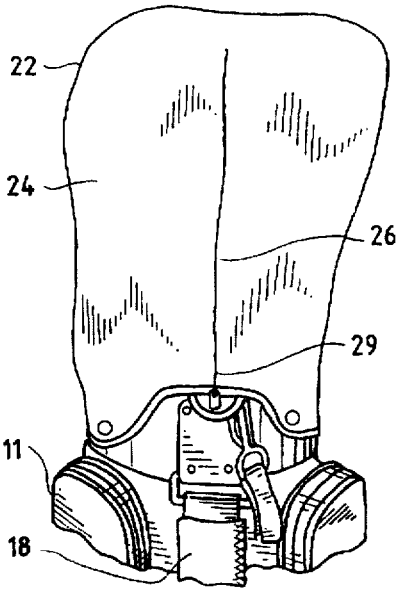
FIG. 6 is a front elevation view of the golf bag, showing the protective hood secured to the top of the body of the golf bag.

The body 11 also includes a pocket 19 with an access opening 20 (See FIG. 2). A zipper-type closure 21 or any other suitable fastener (e.g., hook and loop fastener) normally closes the opening 20. The pocket contains a hood member 22 which is extensible to cover the head portions of the clubs disposed in the body 11 (See FIGS. 5 and 6) and foldable into the pocket 19 for storage (See FIGS. 1, 2 and 4).

The hood member 22 is made out of nylon treated with a suitable water-repellant material. For example, a coating of polyvinyl chloride (PVC) may serve as the water-repellant treatment for the nylon. Alternatively, the hood member 21 may be any other foldable material, including a variety of films and fabrics.

The hood member 22 includes a tab portion 23 and a pouch portion 24 with an opening 25. A slit 26 extends along the length of the pouch portion 24 to enlarge the opening 25 and facilitates placement of the hood member 22 over the golf clubs disposed in the body 11 and around the top end of the body 11. Snap fastener halves 27 (fixedly secured to the pouch portion 24 around the opening 25) cooperate with corresponding fastener halves 28 (fixedly secured to the top end of the body 11) to releasably secure the pouch portion 24 to the top end of the body 11. After placing and fastening the hood member 22 in the position shown in FIGS. 5 and 6, one may close the slit 26 with a zipper closure 29. To store the hood member 22, one need only reverse the procedure outlined above, fold the member as shown in FIGS. 1 and 2, and place it in the pocket 19.

Figure 3:
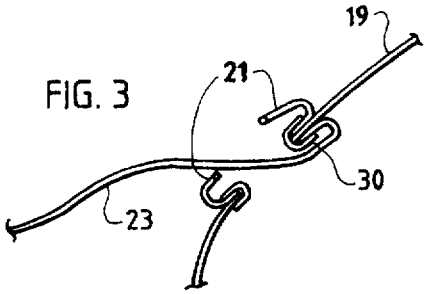
FIG. 3 is a sectional view taken along line 3—3 in FIG. 2.

Stitching as at 30 secures the hood member to the inside of the pocket 19 (See FIG. 3). Specifically, the stitching secures the distal end of the tab portion 23 to the inside of the pocket 19 proximate the opening 20. The tab portion 23 extends through the opening 20 as shown in FIG. 3 when the hood member 22 lies outside of the pocket 19. (Other means such as snap, hook and loop, or zipper fasteners may secure the tab portion 23 to any suitable position in the pocket 19 or proximate the pocket. Moreover, the closure 21 may be any suitable fastener or seal.)

While the above description and the drawings disclose and illustrate one embodiment, one should understand, of course, that the invention is not limited to this embodiment. Those skilled in the art to which the invention pertains may make modifications and other embodiments employing the principles of this invention, particularly upon considering the foregoing teachings. Therefore, by the appended claims, the applicant intends to cover any modifications and other embodiments as incorporate those features which constitute the essential features of this invention.

What is claimed is:

1. A golf bag comprising: a generally tubular bag member having an elongate, generally tubular body with a bottom and an open top, said body including a pocket with an access opening proximate the open top, said pocket being a permanent portion of the body; and a hood member including a tab portion secured to an inner wall of the pocket; the hood member including a foldable shell; the hood member being extensible outwardly of the pocket and the access opening to an operable position for covering an exposed portion of one or more golf clubs disposed in the tubular body and foldable into the pocket for storage while remaining secured to the inside wall of the pocket in the body; said tab portion being substantially narrower than the remaining portions of the hood member.

2. The golf bag of claim 1, wherein the hood member includes a pouch portion for covering the top of the bag member and the exposed portion of one or more of the golf clubs disposed in the body of the bag member, the pouch portion defining an opening for receiving the top of the bag member and the golf clubs.

3. The golf bag of claim 2, wherein the pouch portion defines a closeable slit for enlarging the opening of the pouch portion.

4. The golf bag of claim 3, wherein the pouch portion and a top portion of the tubular bag member proximate the open top have cooperating means for releasably securing the pouch portion around the open top of the tubular bag member.

* * * * *